US007100415B2

(12) United States Patent
Takashima et al.

(10) Patent No.: US 7,100,415 B2
(45) Date of Patent: Sep. 5, 2006

(54) METHOD AND APPARATUS FOR MANUFACTURING A LIQUID EJECTION HEAD

(75) Inventors: Nagamitsu Takashima, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 10/897,396

(22) Filed: Jul. 23, 2004

(65) Prior Publication Data

US 2005/0044919 A1 Mar. 3, 2005

(30) Foreign Application Priority Data

Jul. 23, 2003 (JP) ..... P2003-200467

(51) Int. Cl.
*B21D 17/02* (2006.01)

(52) U.S. Cl. ..... 72/335; 29/890.1; 347/68

(58) Field of Classification Search ..... 72/335, 72/333, 339, 332; 347/68; 29/890.142, 29/890.1

See application file for complete search history.

(56) References Cited

U.S. PATENT DOCUMENTS 3,338,084 A * 8/1967 Stegman, Sr. ..... 72/333
4,425,777 A * 1/1984 Jeglinski ..... 72/325
4,574,445 A * 3/1986 Bentin et al. ..... 29/890.1
5,144,709 A * 9/1992 Rooney ..... 72/335
5,485,664 A * 1/1996 Huang ..... 29/896.2
6,260,272 B1 * 7/2001 Inose et al. ..... 29/890.1
6,328,434 B1 * 12/2001 Soneda et al. ..... 347/68

FOREIGN PATENT DOCUMENTS

JP 2000-108349 * 4/2000
JP 2000-263799 * 9/2000

* cited by examiner

*Primary Examiner*—Daniel C. Crane
(74) *Attorney, Agent, or Firm*—Sughrue Mion, PLLC

(57) ABSTRACT

A metallic plate member having at least one through hole to be a part a common liquid reservoir of a liquid ejection head is provided. In a first die, a plurality of first projections are arrayed in a first direction with a fixed pitch. Each of the first projections is elongated in a second direction perpendicular to the first direction. The plate member is mounted on a second die, and a regulating member is inserted into the through hole. The first projections are pressed against a first region in a first face of the plate member which is adjacent to the through hole in the second direction, so as to generate a plastic flow of a material in the plate member into gaps defined between the first projections, while the plastic flow is regulated by the regulating member. A plurality of recesses formed by the first projections and a plurality of partition walls formed by the material flown into the gaps constitutes a part of the pressure generating chambers.

20 Claims, 19 Drawing Sheets

METHOD AND APPARATUS FOR MANUFACTURING A LIQUID EJECTION HEAD

BACKGROUND OF THE INVENTION

The present invention relates to a liquid ejection head, a method of manufacturing the same, and a mold used in the manufacturing method.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber. Such a structure is disclosed in Japanese Patent Publication No. 2000-263799A, for example.

Since the thickness of the partition wall is extremely thinned, it is hard to accurately obtain the recessed shape of the pressure generating chamber to uniformly set the liquid containing volume thereof. In particular, it is important to fabricate the partition wall to have a predetermined height as seen in the direction of the depth of the pressure generating chamber. By setting the partition wall to have a sufficient height, it is possible to maintain the liquid containing volume of the pressure generating chamber to have a predetermined value. Since the recessed shape is generally elongated in many cases, the length of the partition wall is accordingly increased. For this reason, it is important that the partition wall is to be accurately fabricated over an entire length in order to uniformly maintain the liquid containing volume.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

SUMMARY OF THE INVENTION

It is therefore an object of the invention to precisely form a partition wall having a sufficient height in order to obtain recessed shapes of adjacent pressure generating chambers with high precision.

In order to achieve the above object, according to the invention, there is provided a method of manufacturing a liquid ejection head which ejects liquid droplets by generating pressure fluctuation in liquid contained in a plurality of pressure generating chambers communicated with a common liquid reservoir, the method comprising steps of:

providing a metallic plate member having at least one through hole to be a part the common liquid reservoir;

providing a first die, in which a plurality of first projections are arrayed in a first direction with a fixed pitch, each of the first projections being elongated in a second direction perpendicular to the first direction;

providing a second die, on which the plate member is mounted;

inserting a regulating member into the through hole; and performing a first forging work in which the first projections are pressed against a first region in a first face of the plate member which is adjacent to the through hole in the second direction, the first projections being pressed in a third direction orthogonal to the first direction and the second direction, so as to generate a plastic flow of a material in the plate member into gaps defined between the first projections, while the plastic flow is regulated by the regulating member, wherein a plurality of recesses formed by the first projections and a plurality of partition walls formed by the material flown into the gaps constitutes a part of the pressure generating chambers.

With this configuration, since the flow of the material toward the through hole is regulated by the regulating member, a larger amount of material flows into the gaps so that the partition walls with a sufficient height can be obtained. Therefore, it is possible to secure a finish margin used to adjust the volume and shape of the pressure generating chambers with high precision.

Preferably, a second forging work is performed such that a recess extending in the first direction is formed on the first face of the plate member, before the first forging work is performed. The first region is situated between the recess and the through hole.

In this case, since the plastic hardening is generated by the second forging work at the recess and therearound, the escaping flow of the material can be regulated also by the recess.

Here, it is preferable that the plate member is formed with a pair of through holes, and the recess is formed between the through hole.

In this case, since the recess can be commonly used for the through holes, and the structure of the obtained chamber formation plate can be made simple.

Preferably, the second die comprises a plurality of second projections arrayed in the first direction with a fixed pitch, each of which is elongated in the second direction. The first forging work is performed such that the second projections are opposed to the first projections through the plate member.

Here, it is preferable that each of the second projections is provided with a concave portion at a distal end thereof, so as to extend in the second direction.

Preferably, the manufacturing method further comprises steps of mounting the plate member on a third die having a flat face; and performing a second forging work in which the first projections are pressed against the first region of the plate member under a condition that the flat face opposes to the first projections through the plate member.

Here, it is preferable that the second forging work is performed under a condition that the regulating member is inserted into the through hole.

In this case, the escaping flow of the material can be regulated even when the finishing work is performed.

It is also preferable that the third die comprises a pair of third projections arrayed in the second direction, each of which is elongated in the first direction and has a flat distal end face.

Preferably, the manufacturing method further comprises steps of: polishing a surface of at least one of the first die, the second die and the third die; and performing a hard coating onto the polished surface.

In this case, since the surface of the die is made smooth and hard, the material can be smoothly moved along the die surface to reach prescribed parts of the die (e.g., the gaps). Accordingly, it is effective to secure the sufficient height of the partition walls.

Here, it is preferable that a profile grinding is performed in the polishing step. In this case, precise polishing can be performed even in a part of the die having a complicated shape.

It is also preferable that a diamond like carbon (DLC) film is coated as the hard coating. In this case, since the surface of the die is coated with a carbon coated film equivalent to diamond, an abrasion resistance can be enhanced with a high hardness. In addition, the DLC coated film has a low coefficient of dynamic friction. Therefore, the flow of the material coming in contact with the die can also be carried out smoothly and the height of the partition walls can be increased. In addition, the abrasion resistance is excellent and the damage of the die can also be prevented so that the lifetime of the die is increased.

According to the invention, there is also provided a method of manufacturing a liquid ejection head for ejecting liquid droplets by generating pressure fluctuation in liquid contained in a plurality of pressure generating chambers communicated with a common liquid reservoir, the method comprising steps of:

providing a metallic plate member at least one through hole to be a part the common liquid reservoir;

providing a first die, in which a plurality of first projections are arrayed in a first direction with a fixed pitch, each of the first projections being elongated in a second direction perpendicular to the first direction;

providing a second die, on which the plate member is mounted;

performing a first forging work in which a recess extending in the first direction is formed on a first face of the plate member so as to be adjacent to the through hole in the second direction; and performing a second forging work in which the first projections are pressed against a first region in the first face of the plate member between the through hole and the recess, the first projections being pressed in a third direction orthogonal to the first direction and the second direction, so as to generate a plastic flow of a material in the plate member into gaps defined between the first projections, while the plastic flow is regulated by the recess, wherein a plurality of recesses formed by the first projections and a plurality of partition walls formed by the material flown into the gaps constitutes a part of the pressure generating chambers.

Preferably, the manufacturing method further comprises steps of: polishing a surface of at least one of the first die and the second die; and performing a hard coating onto the polished surface.

Here, it is preferable that a profile grinding is performed in the polishing step, and a diamond like carbon film is coated as the hard coating.

According to the invention, there is also provided an apparatus for manufacturing a liquid ejection head which ejects liquid droplets by generating pressure fluctuation in liquid contained in a plurality of pressure generating chambers communicated with a common liquid reservoir, the apparatus comprising:

a first die, in which a plurality of first projections are arrayed in a first direction with a fixed pitch, each of the first projections being elongated in a second direction perpendicular to the first direction;

a second die, on which a plate member having at least one through hole to be a part the common liquid reservoir is mounted;

a regulating member, adapted to be inserted into the through hole;

a press member, operable to press the first projections against a first region in a first face of the plate member which is adjacent to the through hole in the second direction, under a condition that the regulating member is inserted into the through hole, wherein:

the first projections are pressed in a third direction orthogonal to the first direction and the second direction, so as to generate a plastic flow of a material in the plate member into gaps defined between the first projections, while the plastic flow is regulated by the regulating member; and a plurality of recesses formed by the first projections and a plurality of partition walls formed by the material flown into the gaps constitutes a part of the pressure generating chambers.

Preferably, the second die comprises a plurality of second projections arrayed in the first direction with a fixed pitch, each of which is elongated in the second direction; and the first projections are pressed so as to oppose to the second projections through the plate member.

Preferably, a surface of at least one of the first die and the second die is polished, and a hard coating is provided on the polished surface.

Here, it is preferable that the surface is polished by a profile grinding, and a diamond like carbon film is provided as the hard coating.

According to the invention, there is also provided a punch for forging a metallic plate member to be a part of a liquid ejection head which ejects liquid droplets by generating pressure fluctuation in liquid contained in a plurality of pressure generating chambers communicated with a common liquid reservoir, the punch comprising:

a first die, adapted to be opposed to a first face of the plate member;

a second die, adapted to be opposed to a second face of the plate member which is opposite to the first face; and a plurality of first projections, provided on the first die and arrayed in a first direction with a fixed pitch corresponding to an interval between adjacent pressure generating chambers, each of the first projections being elongated in a second direction perpendicular to the first direction, wherein a surface of at least one of the first die and the second die is polished, and a hard coating is provided on the polished surface.

Preferably, the surface is polished by a profile grinding, and a diamond like carbon film is provided as the hard coating.

According to the invention, there is also provided a liquid ejection head, comprising:

a metallic plate member, comprising:

a first face, formed with a plurality of recesses which are arrayed in a first direction, each of the recesses being elongated in a second direction perpendicular to the first direction;

a second face, formed with a plurality of grooves which are arrayed in the first direction, each of the groove being elongated in the second direction so as to oppose to a center portion in the first direction of each of the recesses; and a through hole, adjacent to the recesses in the second direction so as to connect the first face and the second face;

an elastic plate, joined to the first face of the plate member so as to seal the recesses to form the pressure generating chamber; and a nozzle plate, joined to the second face of the plate member; the nozzle plate formed with a plurality of nozzle orifices from which the liquid droplets are ejected, each of the nozzle orifice being communicated with one of the recesses at the center portion in the first direction thereof;

wherein the through hole is communicated with the respective recesses to be the common liquid reservoir.

With this configuration, the passage communicating with the nozzle orifice and the pressure generating chamber is formed so as to overlap the groove which is formed by the forging work. Since the portions between adjacent passages can be made flat, the joining of the nozzle plate and the plate member by the adhesive agent can be reliably executed.

Preferably, a recess extending in the first direction is formed on the first face of the plate member, and the recesses are formed between the recess and the through hole. In this case, the recess increases the rigidity of the plate member in the vicinity of the recesses. Thus, it is possible to obtain the plate member having high precision without an abnormal deformation such as a curve. Accordingly, the elastic plate and the nozzle plate are bonded to the plate member so that an ink ejection head can be assembled with high precision.

BRIEF DESCRIPTION OF THE DRAWINGS

The above objects and advantages of the present invention will become more apparent by describing in detail preferred exemplary embodiments thereof with reference to the accompanying drawings, wherein:

FIG. 141 is a section view taken along a line XIVI—XIVI in FIG. 14A;

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
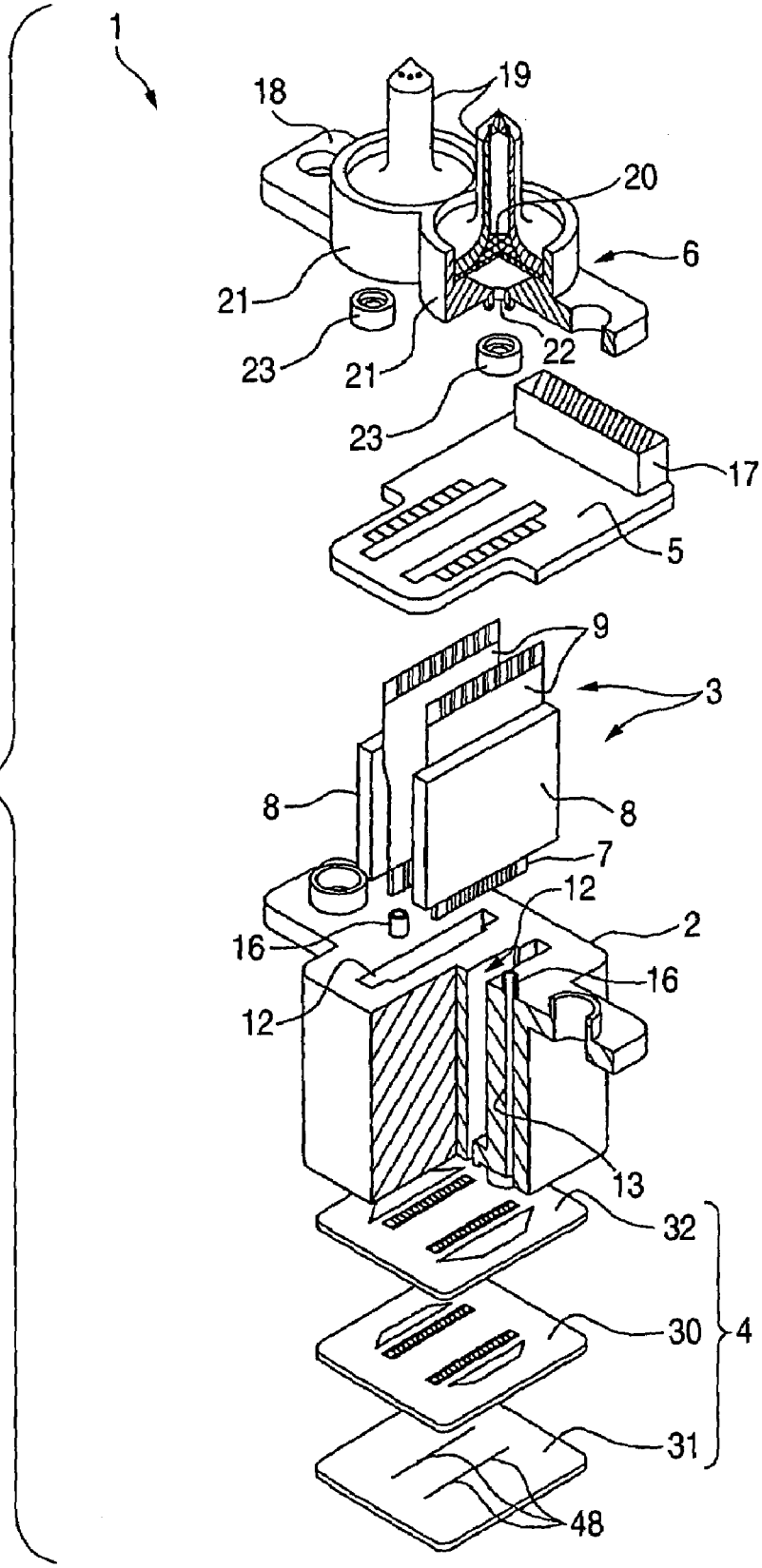
FIG. 1 is a perspective view of a disassembled ink jet recording head according to a first embodiment of the invention.
Figure 2:
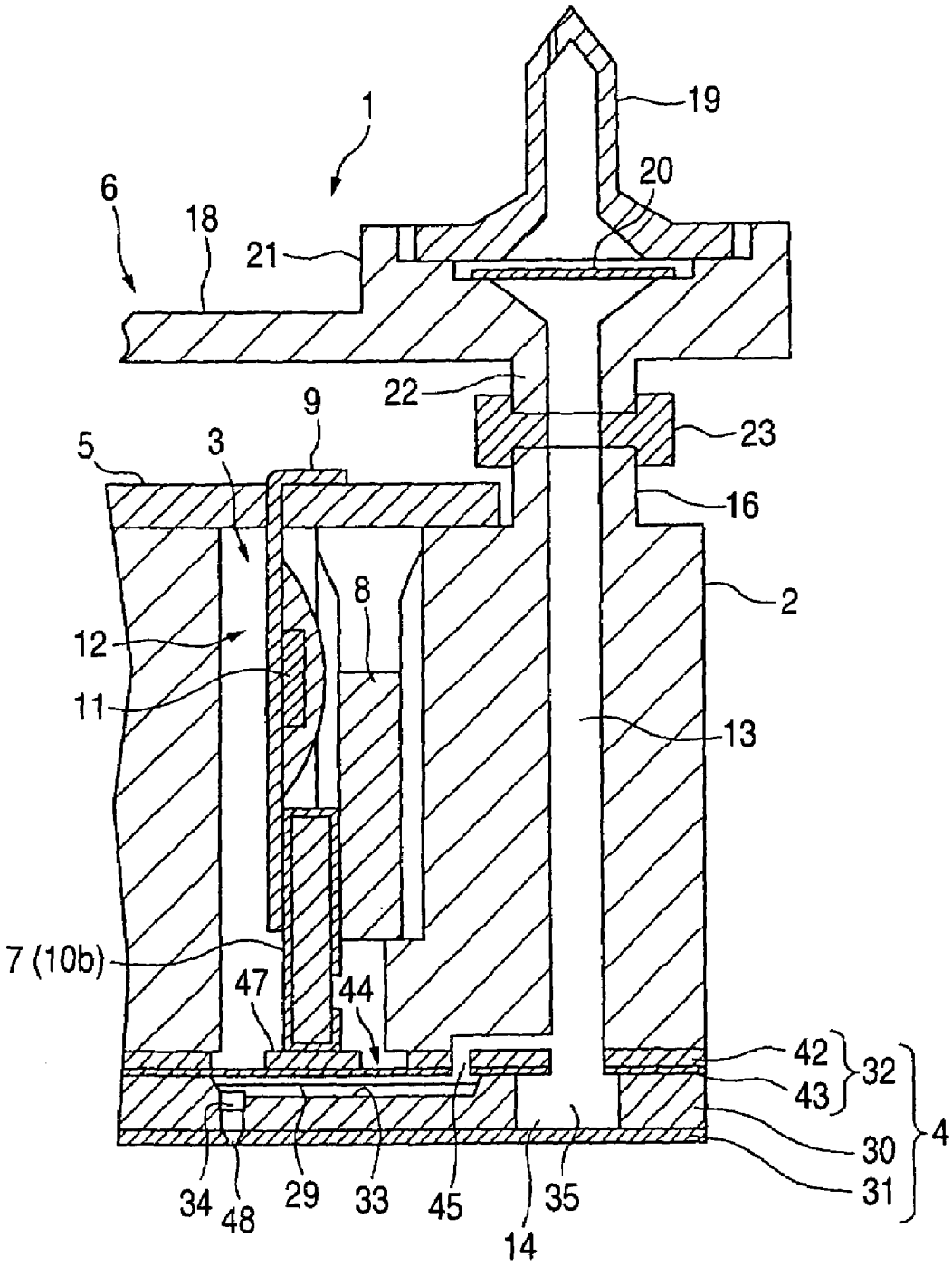
FIG. 2 is a sectional view of the ink jet recording head.

As shown in FIGS. 1 and 2, a recording head 1 according to a first embodiment of the invention is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
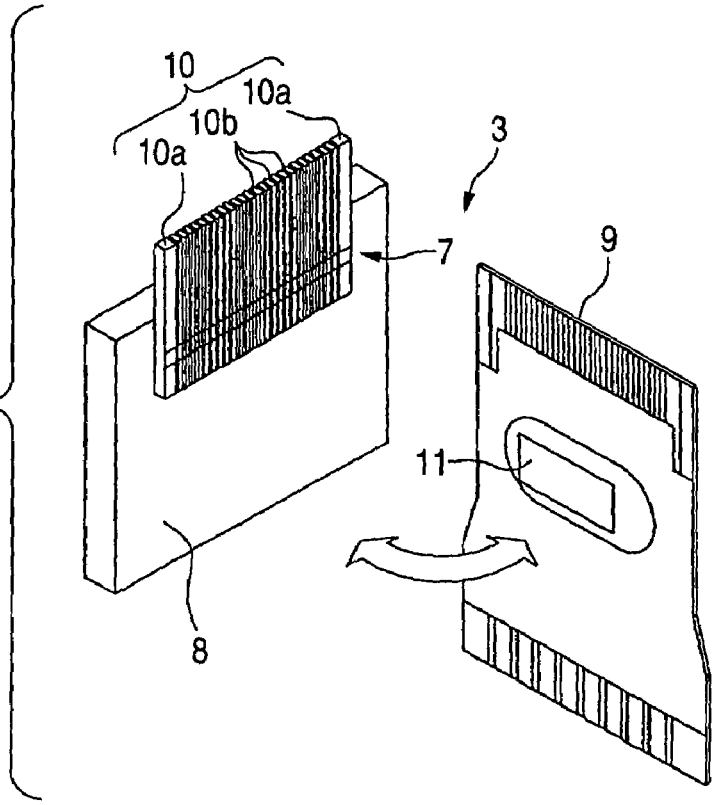
FIGS. 3A and 3B are views for explaining a vibrator unit.
Figure 3B:
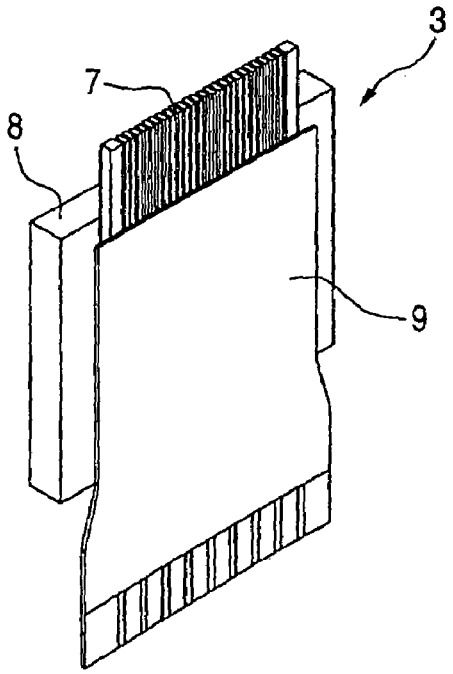

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-shaped member having a rigidity capable of receiving reaction force from the piezoelectric vibrators 10, and a metal plate of a stainless steel plate or the like is preferably used therefor.

The casing 2 is a block-shaped member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink.

The container chamber 12 is a hollow portion having a size of capable of containing the vibrator unit 3. At a portion of a front end side of the container chamber 12, a step portion is formed such that a front end face of the fixation plate 8 is brought into contact therewith.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
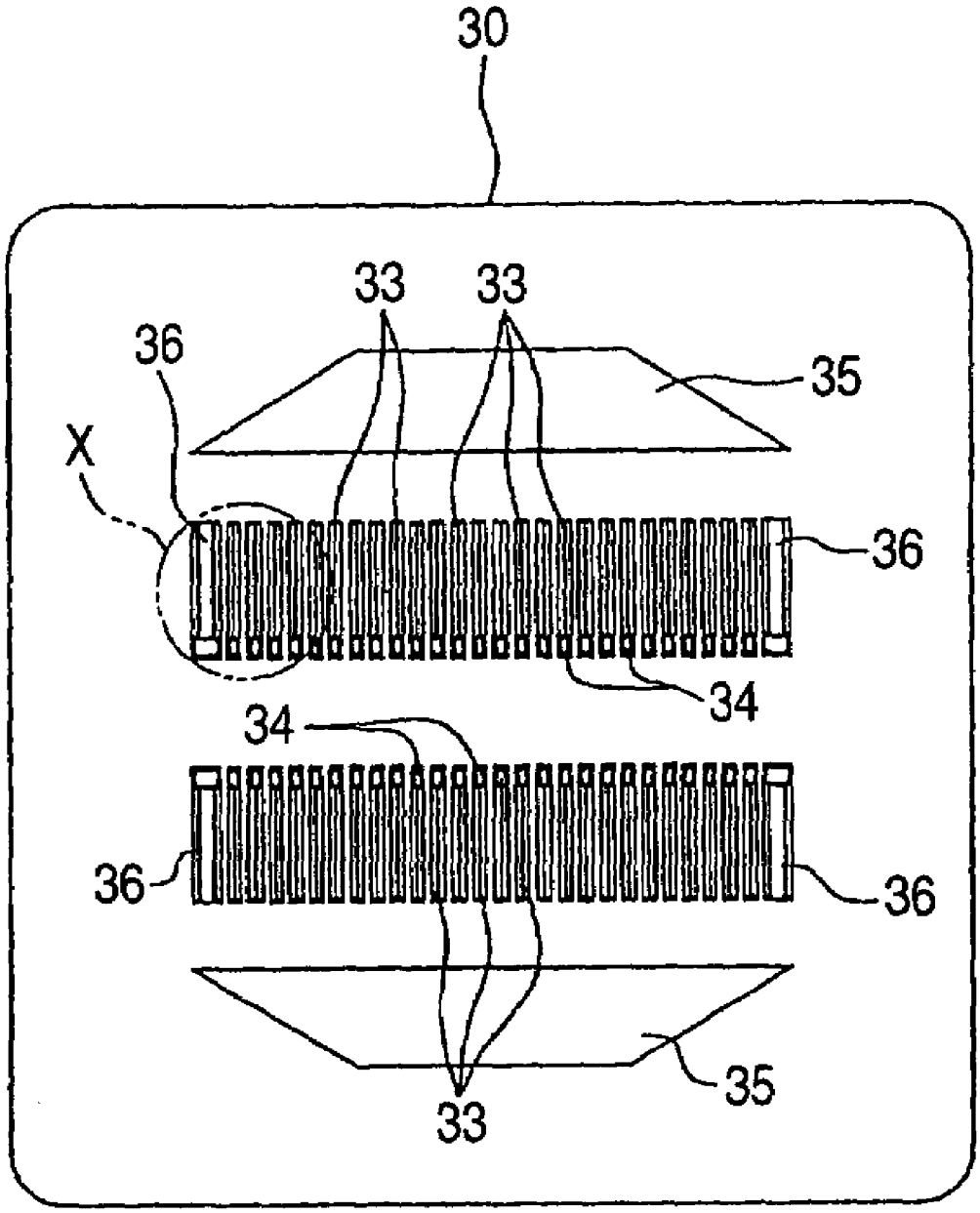
FIG. 4 is a plan view of a chamber formation plate.
Figure 15:
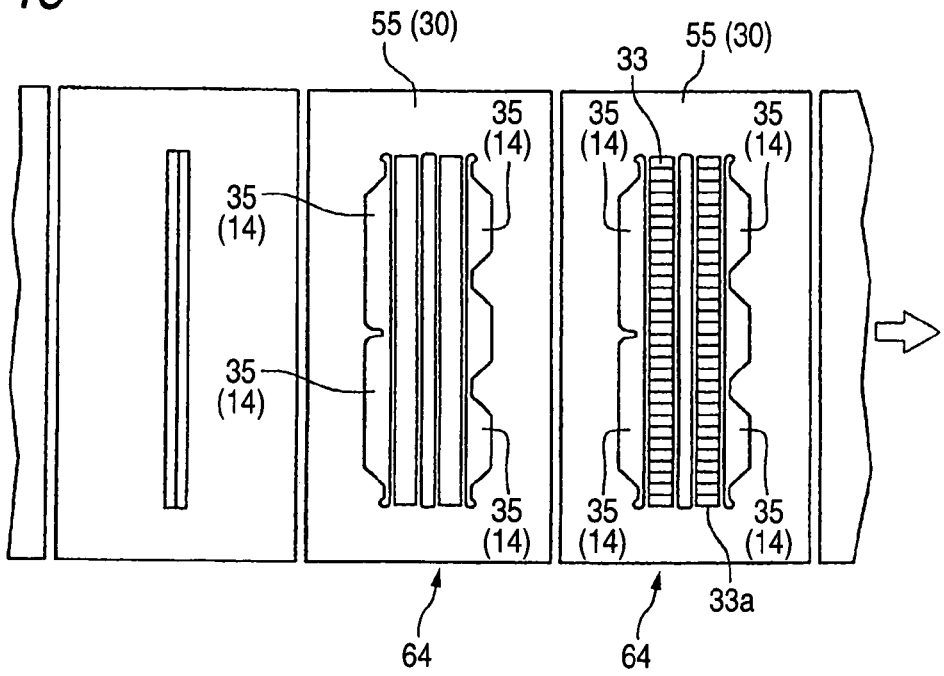
FIG. 15 is a plan view showing how the forging works proceed.

As shown in FIG. 4, the chamber formation plate 30 is a plate-shaped member made of a metal formed with: arrayed elongated recess portions 33 each of which is formed with a communicating port 34; and spaces 35 for forming the common ink reservoirs 14. Each of the spaces 35 is provided as a through hole extending in the arrayed direction of the elongated recess portions 33. FIG. 15 also shows the same spaces 35 as described later. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
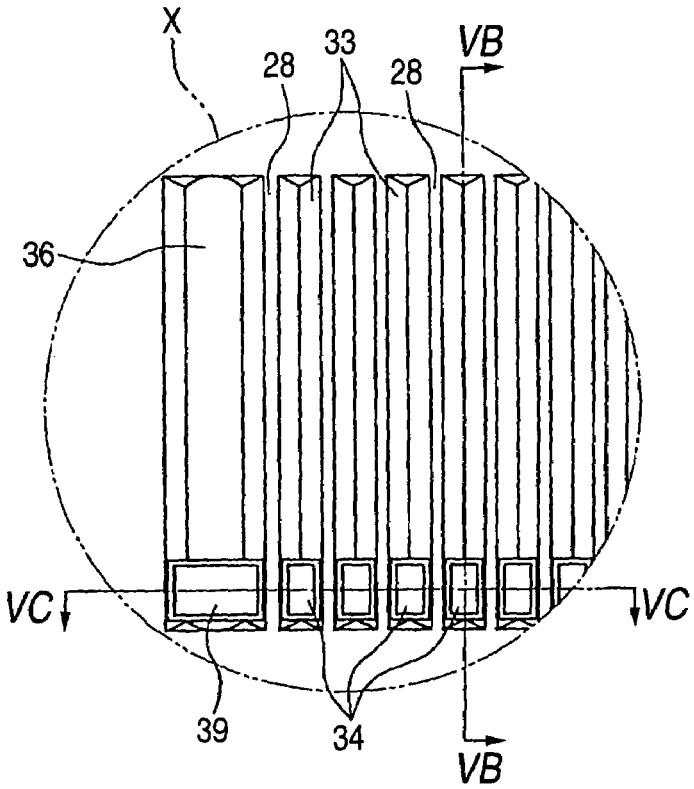
FIG. 5A is a view enlarging an X portion in FIG. 4.
Figure 5B:
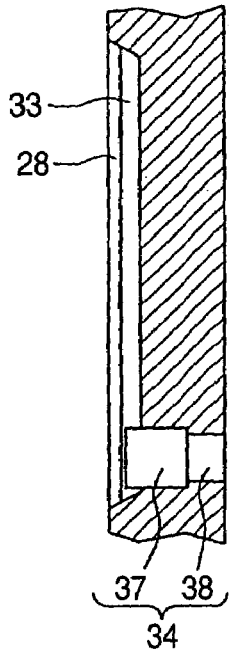
FIG. 5B is a sectional view taken along a line VB—VB of FIG. 5A.
Figure 5C:
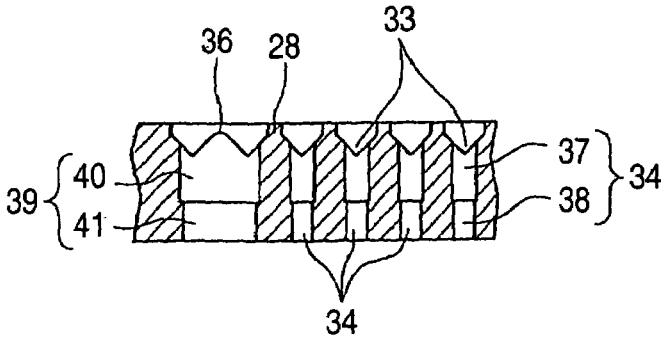
FIG. 5C is a sectional view taken along a line VC—VC of FIG. 5A.
Figure 6:
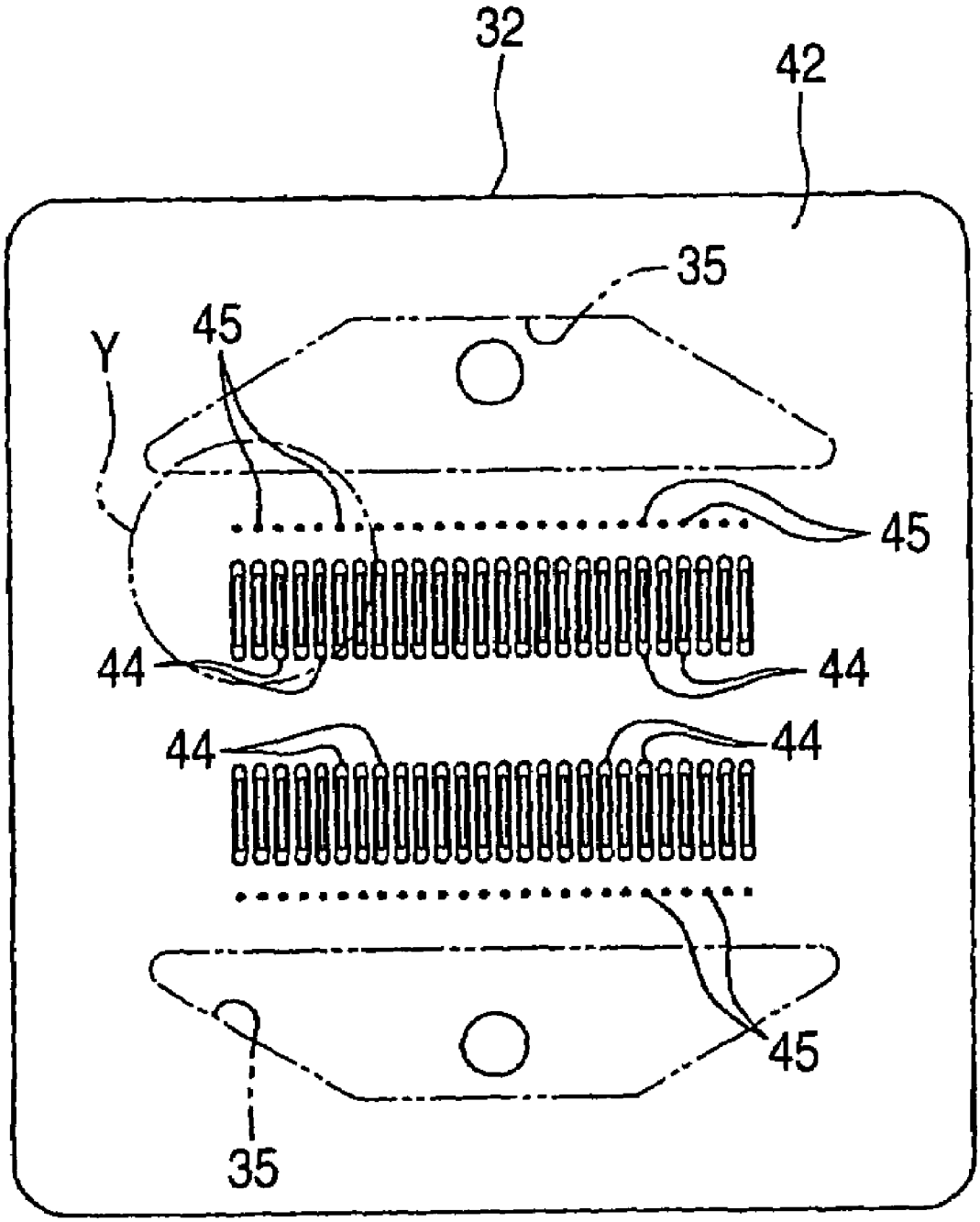
FIG. 6 is a plan view of an elastic plate.

The elongated recess portion 33 is a recess portion in a groove-shaped shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-shaped shape by reducing a width thereof as progressing in a depth direction (that is, depth side). The bottom face is recessed in the V-shaped shape to increase a rigidity of a partition wall 28 for partitioning the contiguous pressure generating chambers 29. That is, by recessing the bottom face in the V-shaped shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-shaped shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-shaped shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-shaped shape. This is also for increasing the rigidity of the partition wall 28 and forming the dummy recess portion 36 with excellent dimensional accuracy by plastic working.

Further, a row of recesses 33*a* is constituted by the respective elongated recess portions 33 and the pair of dummy recess portions 36. According to the embodiment, two rows of the recesses 33*a* are formed as shown in FIG. 4. That is, two pairs of the row of recesses 33*a* and the space 35 are provided.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
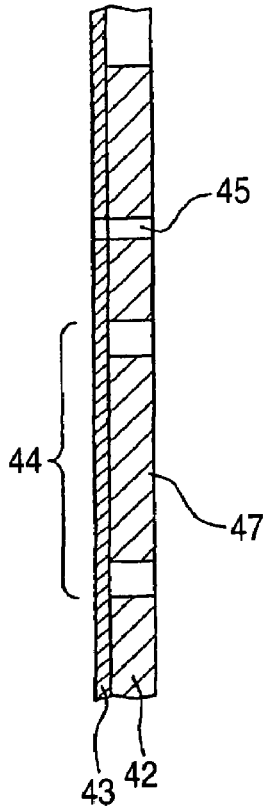
FIG. 7B is a sectional view taken along a line VIIB—VIIB of FIG. 7A.
Figure 7A:
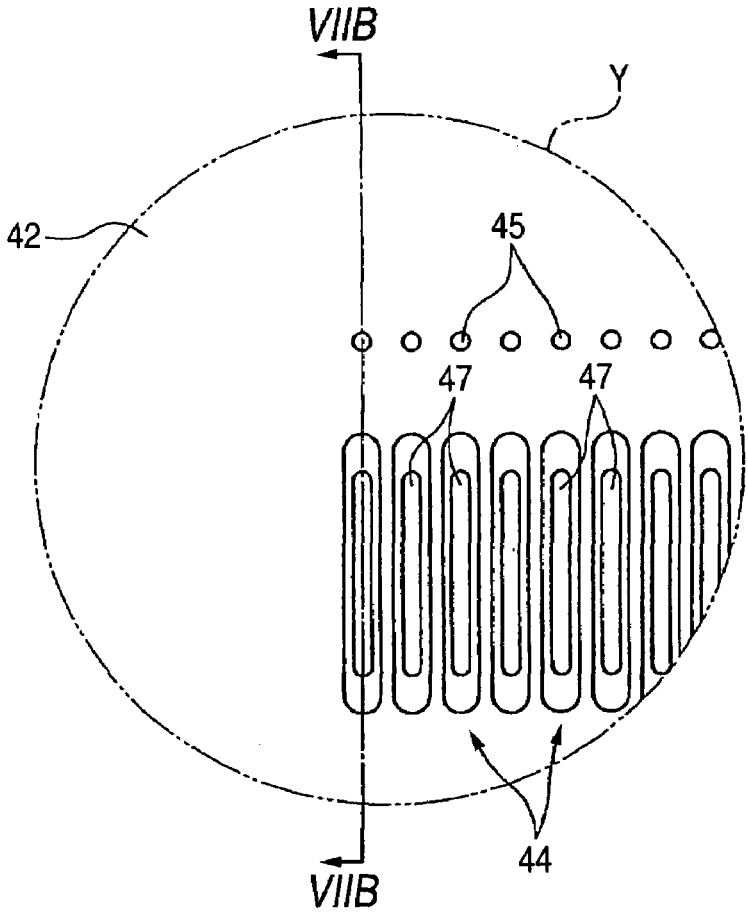
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The support plate 42 and the elastic film 43 which constitute the elastic plate 32 are not restricted to this example. For example, polyimide may be used for the elastic film 43.

Next, the above-described nozzle plate 31 will be explained. The nozzle plate 31 is a plate-shaped member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-shaped shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The steps of manufacturing the chamber formation plate 30 comprises steps of forming the elongated recess portion 33 and steps of forming the communicating port 34 which are carried out by a progressive die.

Figure 8A:
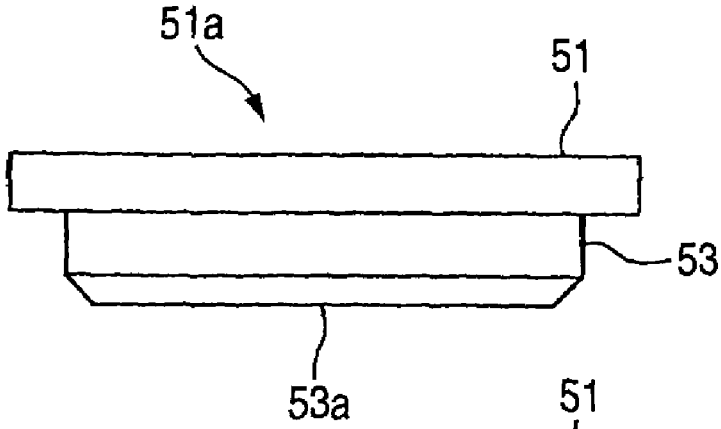
FIGS. 8A and 8B are views for explaining a male die used in forming an elongated recess portion.
Figure 8B:
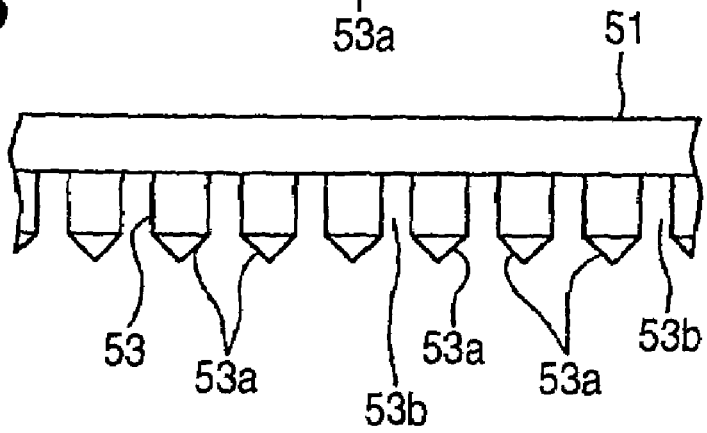
Figure 9A:
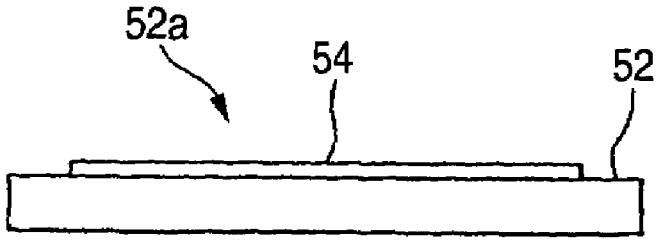
FIGS. 9A and 9B are views for explaining a female die used in forming the elongated recess portion.
Figure 9B:
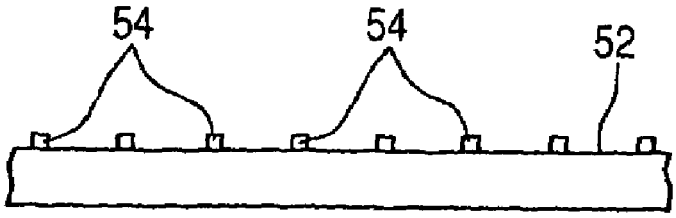

In the elongated recess portion forming steps, a male die 51 shown in FIGS. 8A and 8B and a female die shown in FIGS. 9A and 9B are used. The male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-shaped shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

The male die 51 is referred as a first die 51*a* and the female die 52 is referred as a second die 52*a*. As shown in FIG. 10D, a large number of projections 54 (dashed chain lines) are provided on the second die 52*a* so as to have an almost equal length to the length of the projections 53 (solid lines) in the longitudinal direction thereof, and the projections 53 and the projections 54 have an opposed positional relationship. Because of such a positional relationship, when the material (the chamber formation plate 30) is pressurized between the first die 51*a* and the second die 52*a*, the amount of the pressurization of the material present between the projections 53 and the projections 54 is maximized.

Figure 10A:
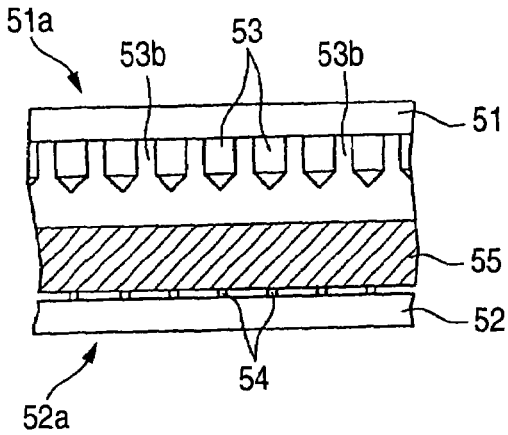
FIGS. 10A to 10D are views for explaining a step of forming the elongated recess portion.
Figure 10B:
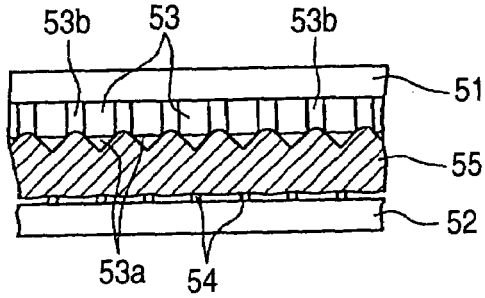
Figure 10C:
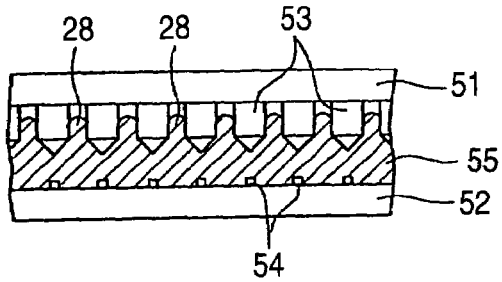
Figure 10D:
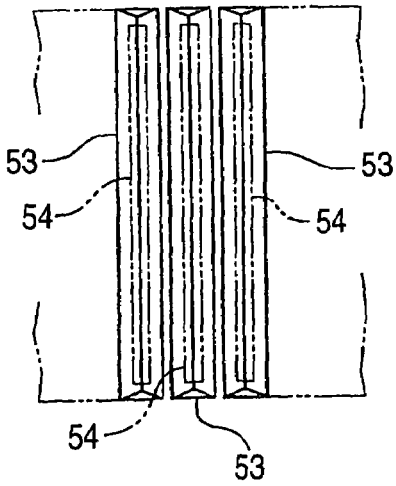

In the elongated recess portion forming steps, first, as shown in FIG. 10A, the strip 55 is mounted at an upper face of the female die 52 and the male die 51 is arranged on an upper side of the strip 55. Next, as shown in FIG. 10B, the male die 51 is moved down to push the distal end portion of the projection 53 into the strip 55. At this occasion, since the distal end portion 53*a* of the projection 53 is sharpened in the V-shaped shape, the distal end portion 53*a* can firmly be pushed into the strip 55 without buckling. Pushing of the projection 53 is carried out up to a middle in a plate thickness direction of the strip 55 as shown in FIG. 10C.

By pushing the projection 53, a portion of the strip 55 flows to form the elongated recess portion 33. In this case, since the distal end portion 53*a* of the projection 53 is sharpened in the V-shaped shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. Since the projection 53 and the projection 54 have the opposed positional relationship as described above, the strip 55 between the projection 53 and the projection 54 is pressurized most greatly. Thereby, the strip 55 can efficiently be introduced into the space (the gap 53*b*) between the projections 53 and the protrusion (i.e., the partition wall 28) can be formed highly.

The plastic working is carried out over the strip (material) 55 by the male die 51 and the female die 52 at the room temperature. Moreover, the plastic working which will be described below is carried out at the room temperature in the same manner.

The elongated recess portion 33 is formed basically as described above. Precision in the formation of the elongated recess portion 33, particularly, how to mold the partition wall 28 is important. In order to meet such needs, in the invention, the plastic flow of the chamber formation plate 30 (the strip 55) is regulated to form the proper partition wall portion 28. At the same time, a forging punch is caused to comprise a first die and a second die including a preforming die and a finishing die, and a special shape is given to the second die to form the proper partition wall 28.

Figure 11:
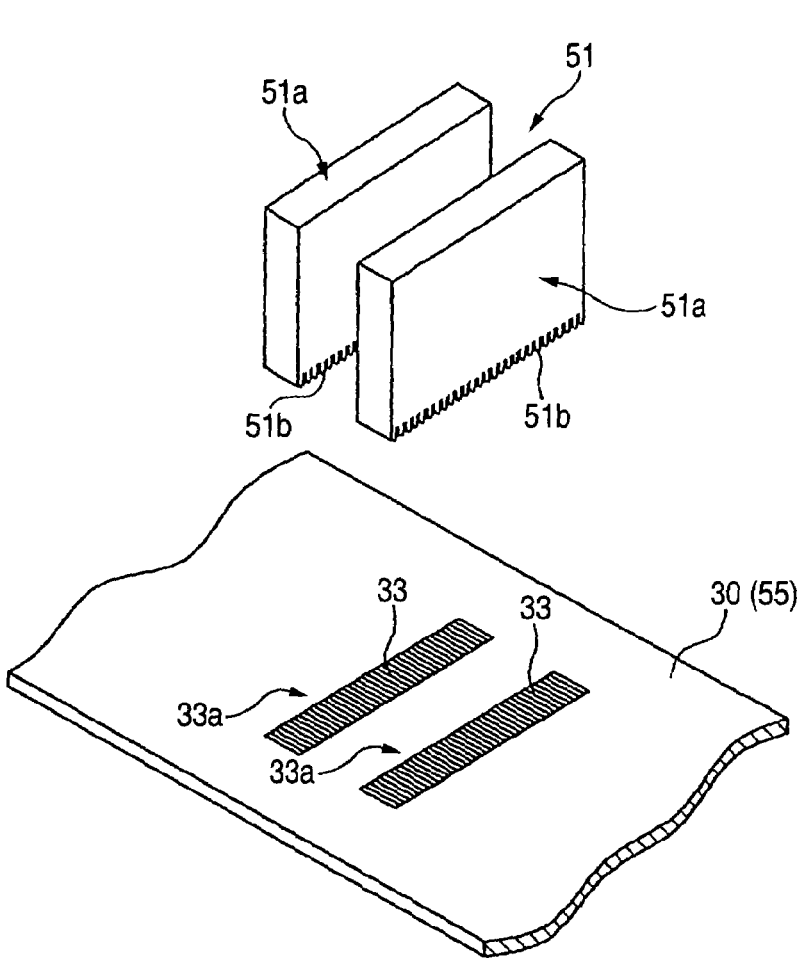
FIG. 11 is a perspective view showing a relationship between the male die and a material to be processed.

As shown in FIG. 11, large number of molding punches 51*b* are arranged in the male die 51*a*, that is, the first die. In order to form the elongated recess portions 33, the molding punches 51*b* are elongated to form projections 53*c*. The projections 53*c* are arranged in parallel at a predetermined pitch. In order to form the partition walls 28, gaps 53*b* (see FIG. 12B) are provided between the molding punches 51*b*. A state in which the first die 51*a* is pushed into the chamber formation plate 30 (strip 55) to be a worked object is shown in FIG. 12C.

In this embodiment, the material (strip) 55 is caused to flow into the gaps 53*b* by the preforming die 56 and the distribution of the material 55 in the gaps 53*b* is caused to approach a normal state as much as possible by the finishing die 57. Consequently, the amount of the flow of the material into the gaps 53*b* is brought into an almost straight state in the longitudinal direction of the gaps 53*b*, which is convenient for the case in which that portions are caused to serve as a member such as the partition wall 28 of the pressure generating chambers 29 of the liquid ejection head 1.

The structure and operation of the second die 52*a* will be described in detail as follows.

Figure 12A:
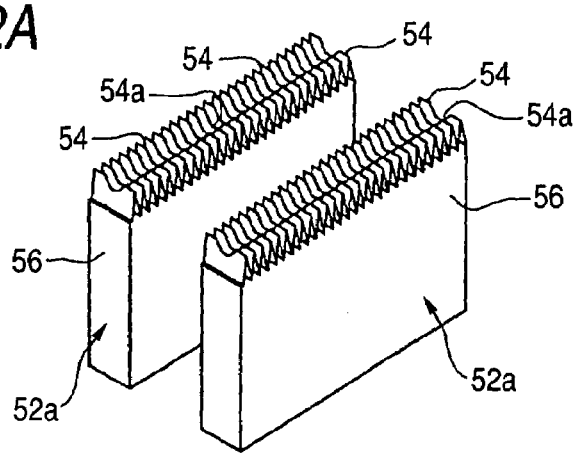
FIG. 12A is a perspective view of a preforming female die according to one embodiment of the invention.

As shown in FIG. 12A, in a female die 52*a*, that is, the second die, each of projections 54 is formed with a concave portion 54*a* at a portion corresponding to the longitudinal middle part of the projection 53*c*. The preforming die 56 is provided with the projections 54 opposed to the gaps 53*b* and having almost the same length as the length of the gaps 53*b*.

Figure 14A:
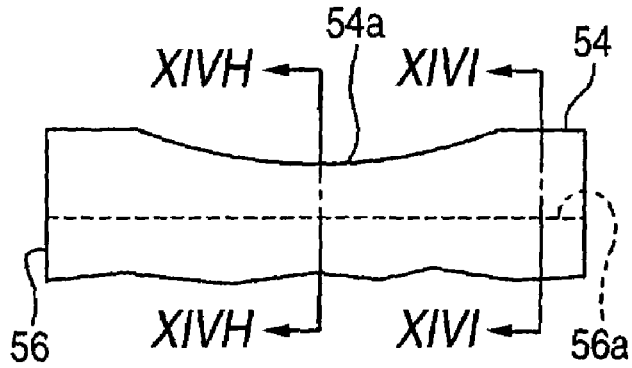
FIG. 14A is an enlarged view of one projection in the preforming female die.

FIG. 14A shows one of the protrusions 54 in which the concave portion 54*a* is formed at the longitudinal center portion thereof.

The length of the concave portion 54*a* of the projection 54 in the longitudinal direction is set to be approximately ⅔ of the length of the projection 54 or less. Preferably, it is ½ of the length of the projection 54 or less. The pitch of the projection 54 is set to be 0.14 mm. The pitch of the projection 54 is set to be 0.3 mm or less so that more suitable preforming is carried out in a forging work of a component such as the liquid ejection head. The pitch is preferably 0.2 mm or less and more preferably 0.15 mm or less. Furthermore, at least the concave portion 54*a* of the projection 54 has a surface thereof finished smoothly. For the finishing, mirror finishing is suitable, and furthermore, chromium plating may be carried out.

Figure 14B:
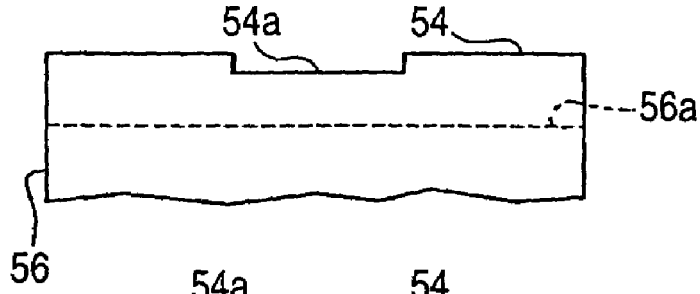
FIG. 14B is an enlarged view of a first modified example of the preforming female die.
Figure 14C:
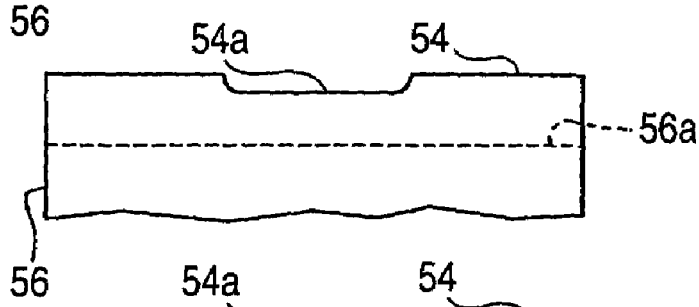
FIG. 14C is an enlarged view of a second modified example of the preforming female die.
Figure 14D:
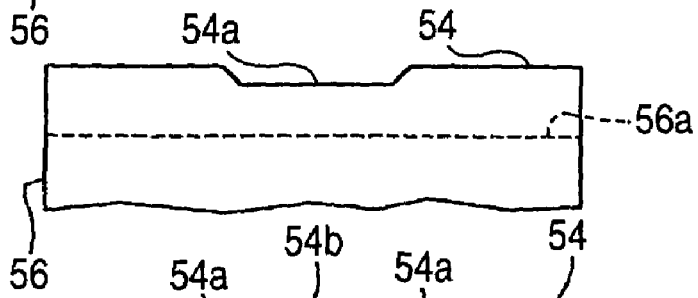
FIG. 14D is an enlarged view of a third modified example of the preforming female die.
Figure 14E:
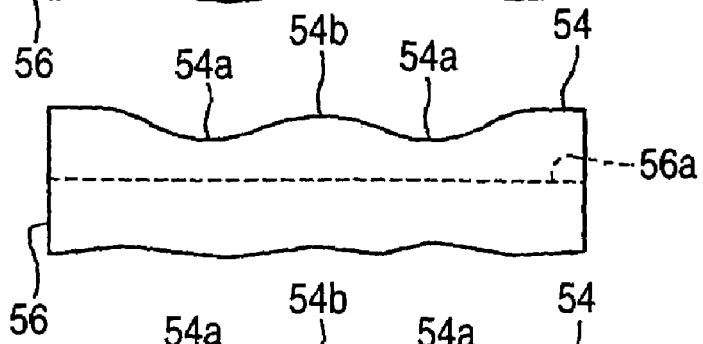
FIG. 14E is an enlarged view of a fourth modified example of the preforming female die.
Figure 14F:
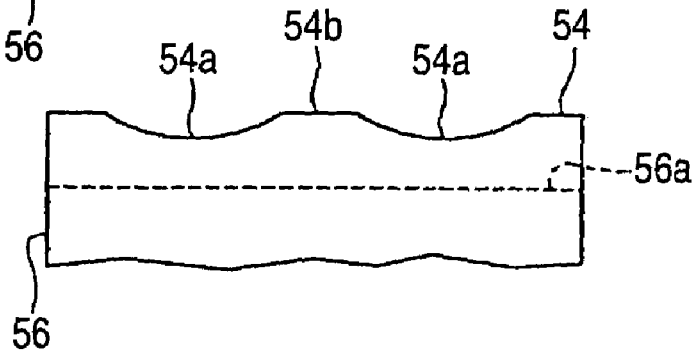
FIG. 14F is an enlarged view of a fifth modified example of the preforming female die.

FIG. 14B shows a first modified example of the preforming die 56 in which the convex portion 54*a* is formed with flat faces. FIG. 14C shows a second modified example of the preforming die 56 in which only bottom corners of the convex portion 54*a* are curved. FIG. 14D shows a third modified example of the preforming die 56 in which the convex portion 54*a* is formed with sloped flat side faces and a flat bottom face. FIG. 14E shows a fourth modified example of the preforming die 56 in which the convex portion 54*b* substantially defines two concave portions 54*b* at both sides thereof. FIG. 14F shows a fifth example of the preforming die 56 in which a top of the convex portion 54*b* shown in FIG. 14E is made flat Since the concave portion 54*a* is formed by removing a part of the ridge-shaped projection 54, as shown in FIGS. 14H and 14I, the top face of the projection 54 is made flat at the concave portion 54*a*.

Figure 14G:
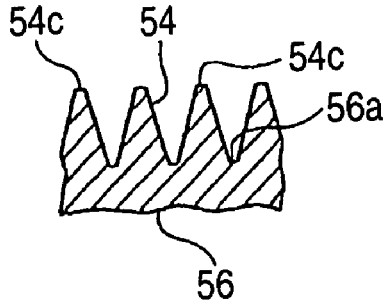
FIG. 14G is a section view of the preforming female die of FIG. 14F.
Figure 14H:
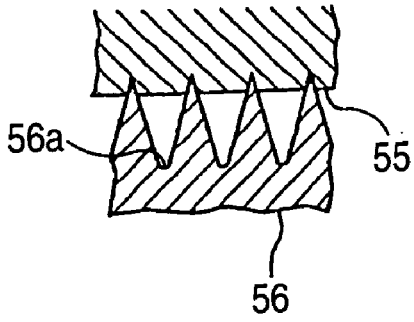
FIG. 14H is a section view taken along a line XIVH—XIVH in FIG. 14A.
Figure 14I:
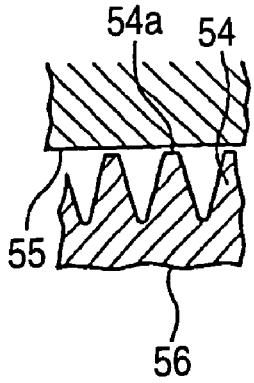

While the projection 54 is wedge-shaped and has a sharp tip portion, a flat top surface 54*c* or *a* rounded tip portion may be formed as shown in FIG. 14G depending on the moving condition of the material 55.

Figure 13A:
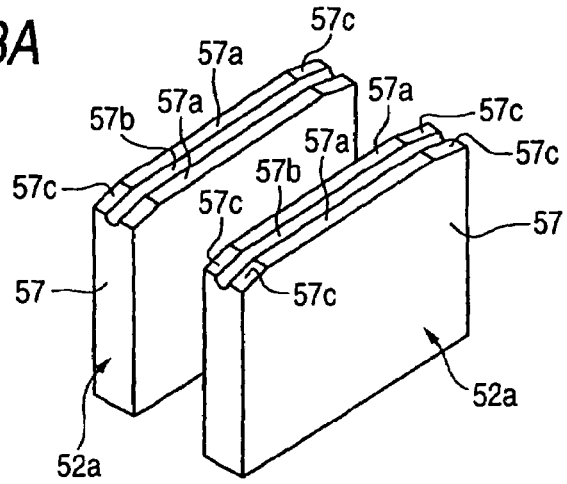
FIG. 13A is a perspective view of a finishing female die according to one embodiment of the invention.

The finishing die 57 is used after the primary molding using the preforming die 56. As shown in FIG. 13A, the finishing die 57 is formed with flat surfaces 57*a* located both sides of a concave portion 57*b*. The flat surfaces 57*a* and the concave portion 57*b* are extended entirely in the longitudinal direction of the finishing die 57. The concave portion 57*b* is located at a part corresponding to the concave portions 54*a* of the projections 54 in the preforming die 56.

Slope faces 57*c* are provided both longitudinal ends of each flat surface 57*a* such that portions closer to the ends are lowered.

The first die 51*a* and the second die 52*a* are fixed to an ordinary forging apparatus (not shown) in which a die carries out an advancing or retreating operation, and the chamber formation plate 30 (material strip 55) is provided between both of the dies 51*a* and 52*a* and the working is sequentially carried out. Moreover, the second die 52*a* is constituted by making a set of the preforming die 56 and the finishing die 57. Therefore, it is proper that the preforming die 56 and the finishing die 57 are arranged adjacently to a forging apparatus of a progressive type to sequentially move the chamber formation plate 30.

Next, description will be given to the operation of the forging punch constituted by the first die 51*a* and the second die 52*a*.

Figure 12B:
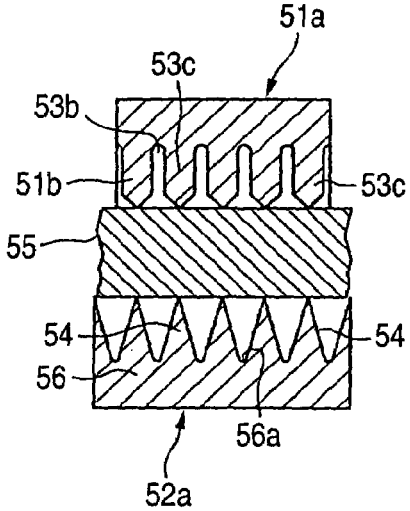
FIGS. 12B and 12C are sectional views showing a primary molding.
Figure 12C:
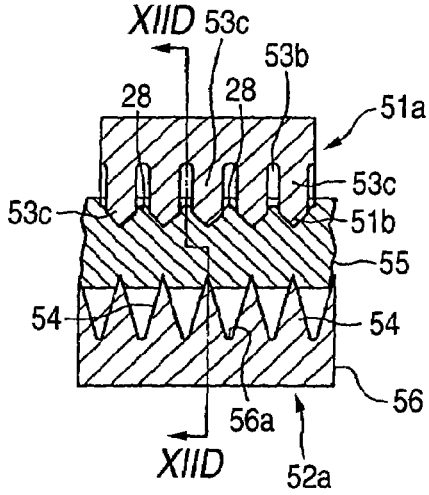
Figure 12D:
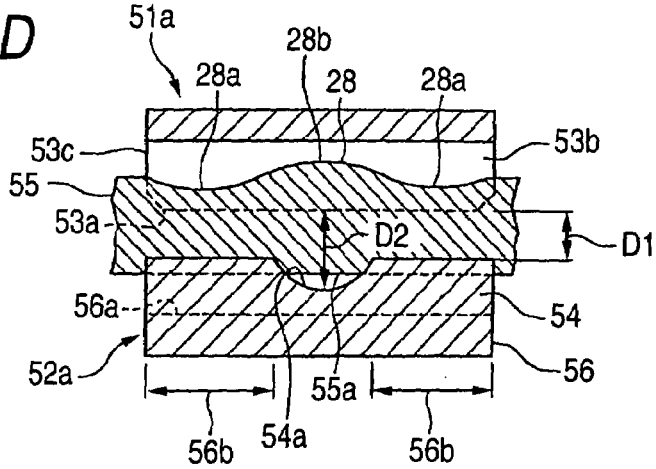
FIG. 12D is a sectional view taken along a line XIID—XIID in FIG. 12C.

FIG. 12B shows a state obtained immediately before the material (strip) 55 is pressurized between the first die 61*a* and the second die 52*a*. When the projections 54 are pressed into the material 55 as shown in FIGS. 12C and 12D, the material is caused to flow into the gaps 53*b* so that the partition wall 28 is preformed.

Incidentally, the second die 52*a* is provided with the concave portion 54*a* having a small height in a middle part. In portions 56*b* close to the ends of the second die 52*a* on both sides of the concave portion 54*a* (see FIG. 12D), an interval D1 between both of the dies 51*a* and 52*a* is smaller than an interval D2 between the middle parts thereof where the concave portion 54*a* is formed. In this narrow portion, the amount of the pressurization of the material is increased so that the material thus pressurized is caused to flow to be pushed out in a direction which is almost orthogonal to the direction of the pressurization. That is, the material is moved toward the concave portion 54*a* in which the amount of the pressurization is smaller. In other words, the concave portion 54*a* serves to provide a place into which the material 55 escapes. Such a material movement is mainly carried out in the longitudinal direction of the projections 53*c* or the gaps 53*b*, so that a part of the material 55 becomes a bulged portion 55*a* which is protruded into the concave portion 54*a*.

Furthermore, a much larger amount of the material 55 is positively pushed into the gaps 53*b* by the contribution of the sufficient height of the projections 54. In the partition wall 28 set in such a preforming state, lower portions 28*a* and a higher portion 28*b* are formed as shown in FIG. 12D. Such a difference in the height is made because a larger amount of the material 55 pressurized in the end portions 56*b* flows to the concave portion 54*a* while a large amount of the material 55 flows into the gaps 53*b* simultaneously.

Moreover, since the projections 53*c* are arranged at a predetermined pitch, the plastic flow of the material in the transverse direction of the projections 53*c* caused by the press-fitting operation is smoothly made uniform for both the direction of the flow and the amount of the flow.

Since the material 55 flowing into the gaps 53*b* as configured the above constitutes the partition wall 28 of the elongated recess portions 33, the shape of the elongated recess portion 33 can be formed accurately. For forming such a minute structure, an anisotropic etching method is generally employed. Since such a method requires a large processing man-hour, it is disadvantageous in respect of the manufacturing cost. On the other hand, if the forging punch is used for a metallic material such as nickel, the processing man-hour is considerably reduced. Furthermore, since the processing can be carried out with a uniform volume of each elongated recess portion 33, in a case where the pressure generating chamber of the liquid ejection head is to be formed, the ejection performance of the liquid ejection head is stabilized.

Figure 13B:
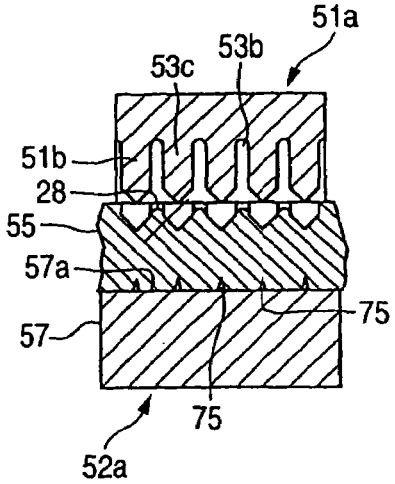
FIGS. 13B and 13C are sectional views showing a secondary molding.
Figure 13C:
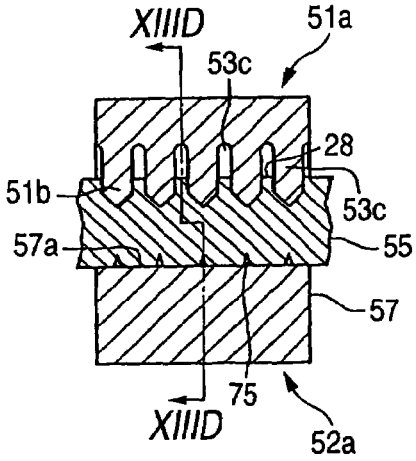
Figure 13D:
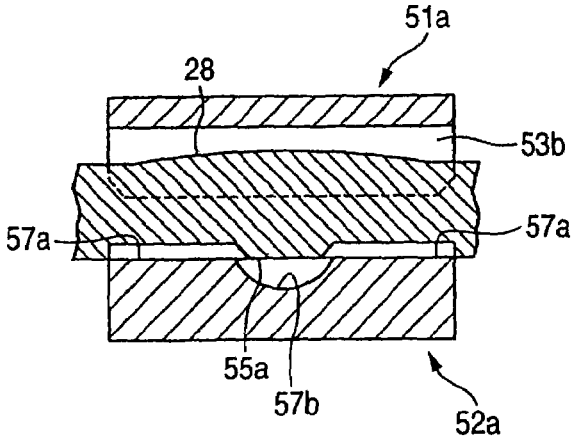
FIG. 13D is a sectional view taken along a line XIIID—XIIID in FIG. 13C.

When the primary molding shown in FIGS. 12C and 12D is completed, the material 55 is moved between the first die 51*a* and the finishing die 57 as shown in FIG. 13B, and is pressurized therein by both of the dies 51*a* and 52*a* as shown in FIG. 13C. The flat surfaces 57*a* increases the amount of the material 55 flowing into the gaps 53*b* so that the heights of the lower portions 28*a* are increased. Incidentally, since the bulged portion 55*a* is accommodated in the concave portion 57*b* and does not receive pressurizing force from the finishing die 57, the height of the higher portion 28*b* is rarely changed. Accordingly, the height of the partition wall 28 finally becomes almost uniform as shown in FIG. 13D.

In the finishing forming stage, since the slope faces 57*c* are formed, the amount of the material 55 flowing into each gaps 53*b* is caused to be as uniform as possible in all the gaps 53*b*. Namely, the material 55 flows in the arrangement direction of the projections 53 little by little from the central part of the array of the projections 53 toward the both ends thereof so that the vicinity of the ends of the material are made thick due to the accumulation of the plastic flow. Since the thick portions are pressurized by the slope faces 57*c* which are lowered, the material in the thick portions can be prevented from excessively flowing into the gaps 53*b*. Accordingly, the amount of the flow of the material 55 can be as uniform as possible in all the gaps 53*b*.

By suppressing the flow of the material when the plastic working described the above is performed, the object of the invention can be attained. This will be described below with reference to FIG. 15 through 21.

FIG. 15 shows a state that the material strip 55 is forward transferred in a forging apparatus. Although they are not shown in this figure, the preforming die 56 of the second die 52*a* is provided in a portion of a preforming stage 63, and the finishing die 57 of the second die 52*a* is also provided in a portion of a finishing stage 64.

Before the preforming is carried out, a preworking is executed in the upstream (left side in FIG. 15) of the stages 63 and 64. The preworking includes the formation of a slender regulation recess 65 extending in parallel with the rows of the elongated recess portions 33 (see FIG. 16A) and the punching of the spaces 35 to be the common ink reservoir 14 (see FIG. 16B). By the press formation of the regulation recess 65, a bulged portion 66 appears on a surface at the opposite side of the material strip 55.

Figure 16A:
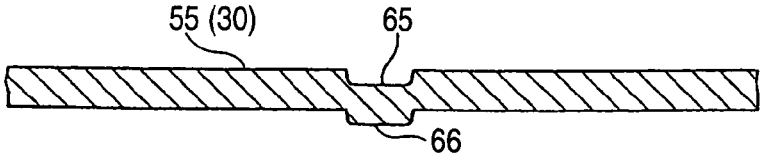
FIGS. 16A and 16B is section views of metal strip subjected to preworking.
Figure 16B:
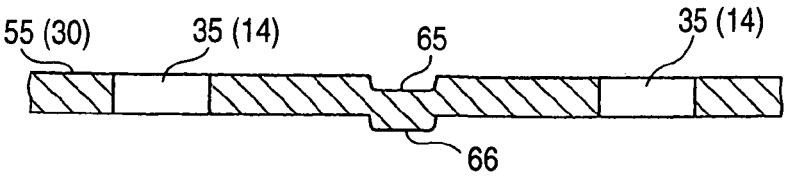
Figure 17A:
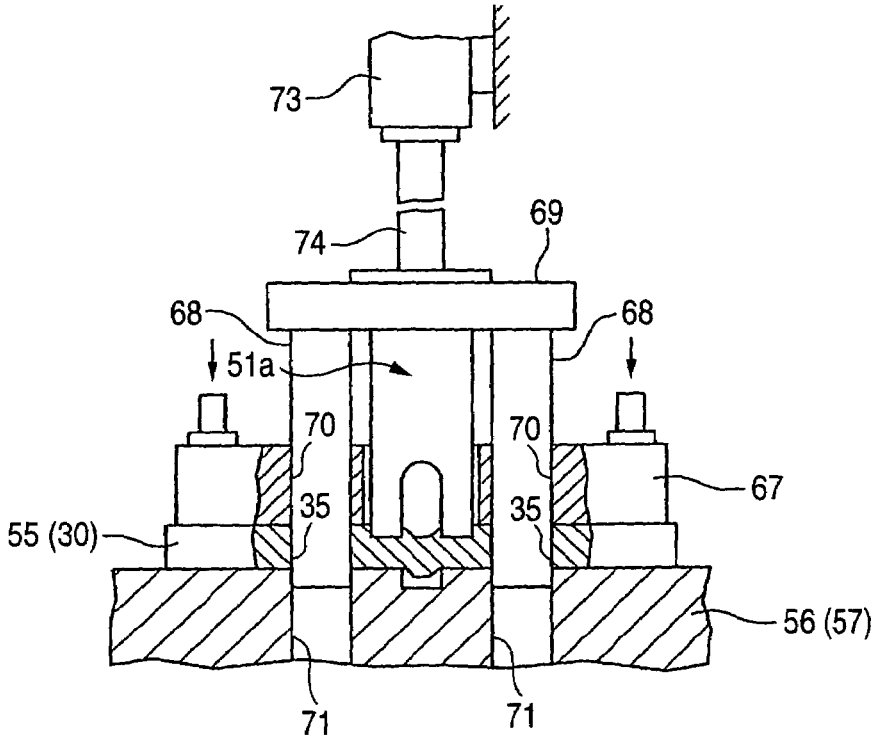
FIG. 17A is a schematic section view of an apparatus for performing the forging works.

FIG. 17A shows a forging apparatus for performing the preforming step and the finishing step. The preworked material strip 55 shown in FIG. 16B is mounted on the preforming die 56 (the finishing die 57) and is pressurized by a pad 67 to restrain the movement of the material strip 55. Two regulating members 68 are fixed on a connecting board 69 so as to extend vertically and in parallel with each other. Each of the regulating members 68 is configured to be inserted into the space 35 without clearance, while passing through a guide hole 70 formed in the pad 67 and a guide hole 71 formed in the second die 52*a* (the preforming die 56 and the finishing die 57).

The first die 51*a* on which the projections 53*c* and the gaps 53*b* are alternately arrayed is fixed on the connection board 69 between the regulating members 68. The arrayed direction of the projections 53*ac* and the gaps 53*b* is orthogonal to the sheet face of FIG. 17A The regulation recess 65 also extends in the same direction. The second die 52*a* is formed with a recess 72 for accepting the protrusion 66.

Figure 17B:
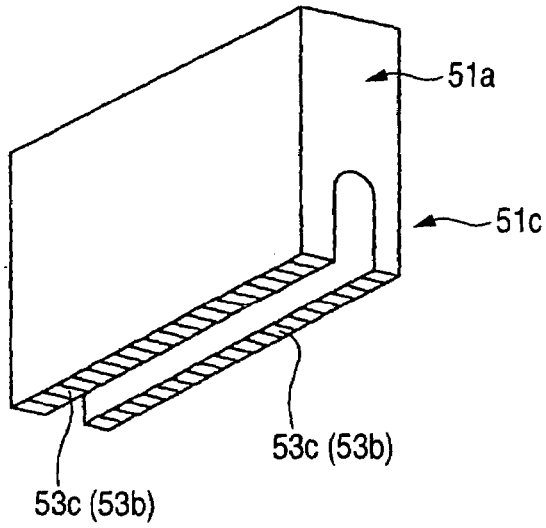
FIG. 17B is a perspective view of a male die incorporated in the apparatus of FIG. 17A.
Figure 18:
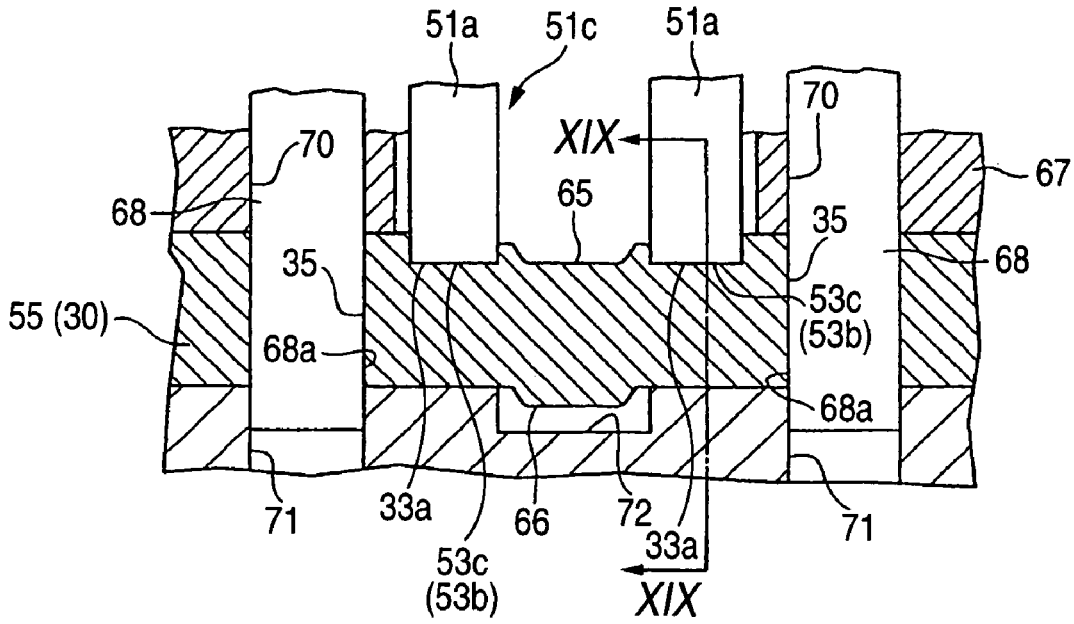
FIG. 18 is an enlarged section view of an essential portion of the apparatus of FIG. 17A.

Since two pairs of the row 33*a* of the elongated recess portions 33 and the space 35 are provided and the regulation recess 65 is formed between the rows 33*a*, the first die 51*a* is formed with a forked portion 51*a* as shown in FIG. 17B such that the projections 53*c* and the gaps 53*b* are formed at the respective divided tip ends. When the pressing work of the first die 51*a* is performed, the regulation recess 65 is placed between the divided tip ends.

A hydraulic cylinder 73 is provided for driving the first die 51*a* and the regulating member 68 to be moved upward and downward, and a piston rod 74 of the hydraulic cylinder 73 is fixed to the coupling board 69. The tip end of the regulating member 68 is situated lower than the tip end of the first die 51*a*, so that the plastic work by the first die 51*a* is performed after the regulating member 68 entirely penetrates the material strip 55, that is, after the condition capable of suppressing the plastic flow of the material strip 55 is established.

Figure 16C:
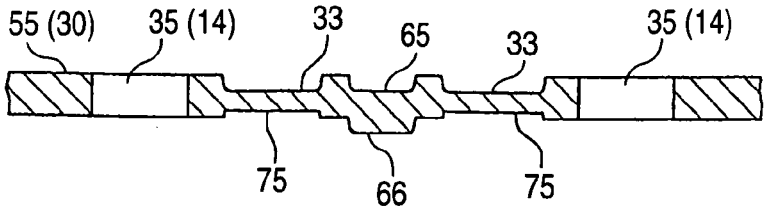
FIG. 16C is a section view of the metal strip subjected to the forging works.

When the regulating member 68 and the first die 51*a* are stopped in positions placed apart from the preforming die 56 by the upward movement of the hydraulic cylinder 73, the preworked material strip 55 shown in FIG. 16B causes the space 35 to be coincident with the guide hole 71 and is mounted on the preforming die 56, and the material strip 55 is then pressed firmly onto the preforming die 56 by the pad 67. When the regulating member 68 and the first die 51*a* are moved downward the regulating member 68 is first inserted into the space 35. In this state, at least the outer periphery 68*a* of the regulating member 68 is brought in contact with the material strip 55 (see FIG. 18). When the first die 51*a* is further moved downward, the projection 53*c* is cut into a region between the regulation recess 65 and the regulating member 68 so that the preforming is carried out, thereby an intermediate product shown in FIG. 16C is obtained.

Figure 19A:
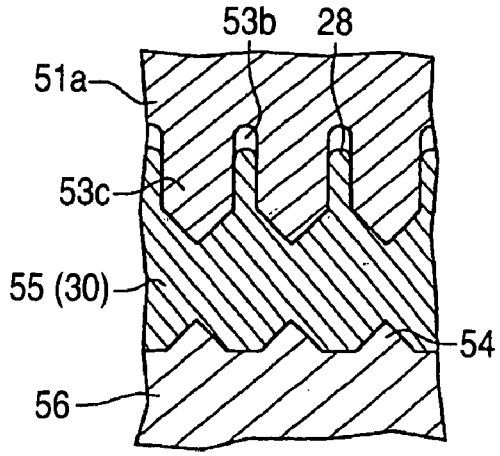
FIG. 19A is a section view taken along a line XIX—XIX in FIG. 18, showing a condition that a preforming work is performed.
Figure 19B:
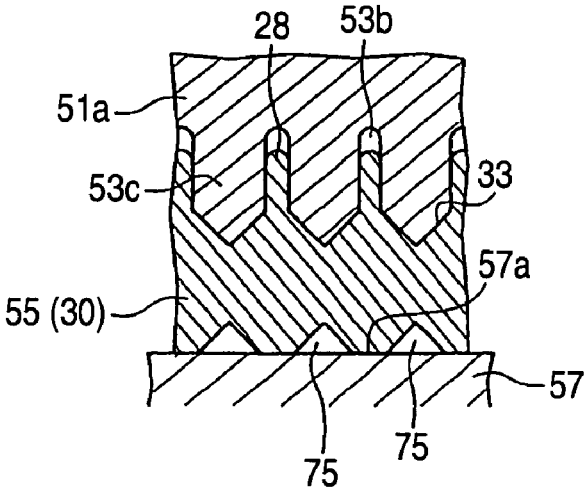
FIG. 19B is a section view taken along the line XIX—XIX in FIG. 18, showing a condition that a finishing work is performed.
Figure 20:
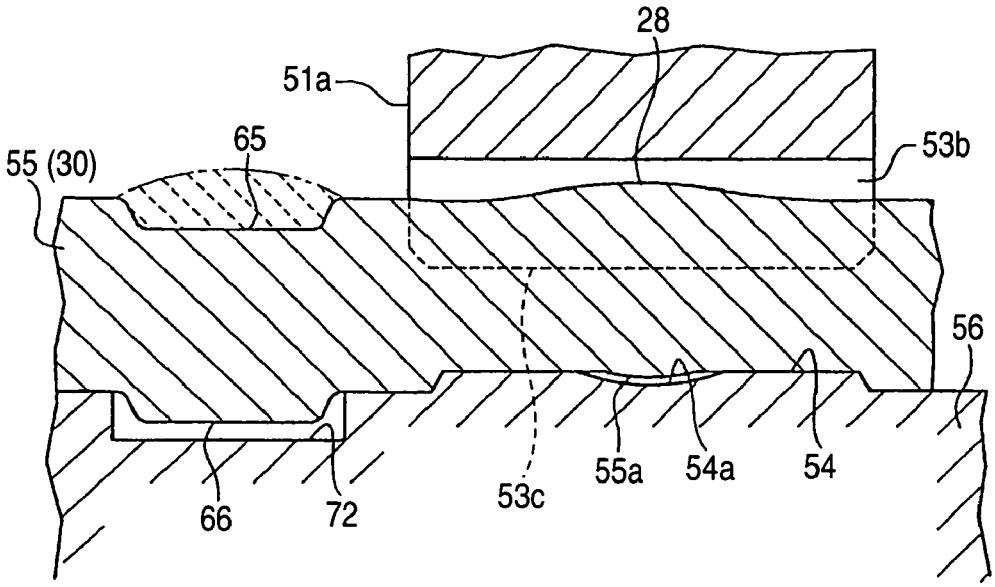
FIG. 20 is an enlarged section view for explaining the effect of a regulation recess formed in the metal strip.

FIG. 19A shows the plastic working performed by the first die 51*a* and the preforming die 56, and FIG. 19B shows the plastic working performed by the first die 51*a* and the finishing die 57.

In the preformation, the flow of the material strip 55 to flow to one side of the row 33*a* Of the elongated recess portions 33 is hindered by the regulating member 68, while the flow of the material strip 55 to flow to the other side of the row 33*a* is hindered by the regulation recess 65. If the regulation recess 65 is not provided, the material strip 55 is bulged as shown in the dashed lines of FIG. 20, so that the amount of the material strip 65 to stay in the gap 53*b* is decreased. However, according to the provision of the regulation recess 65, a large amount of the material strip 55 actually flows into the gaps 53*b*. Moreover, the regulation recess 65 is formed by the plastic working. Therefore, work hardening is generated over the regulation recess 65 and the material strip 55 in the vicinity thereof in the plastic working. By the hardened portion, a plastic flow is further suppressed.

Further, the amount of the pressurization and deformation of the material strip 55 between the projections 53*c* and 54 which are opposed to each other is the largest. Consequently, the material strip 55 flows in a large amount into the gaps 53*b* between the adjacent projections 53*c*. In other words, the material strip 55 is hardly moves in the direction of the arrayed direction of the elongated recess portions 33 to be formed. Thus, the amount of the flow into the gaps 53*b* is further increased. Accordingly, the height of the partition walls 28 formed in the gaps 63*b* can be maintained sufficiently.

As described the above, since the regulation recess 65 is situated between the rows 33*a* of the elongated recess portions 33. Not only the rows 33*a* of the elongated recess portions 33 are simultaneously and efficiently formed by the provision of single regulation recess 65, but also the structure of the obtained chamber formation plate 30 can be made simple.

Further, the regulation recess 65 increases the rigidity of the chamber formation plate 30 in the vicinity of the elongated recess portion 33. Thus, the rigidity of the chamber formation plate 30 itself can be increased to obtain the chamber formation plate 30 having high precision without an abnormal deformation such as a curve. Accordingly, the elastic plate 32 and the nozzle plate 31 are bonded to the chamber formation plate 30 so that an ink ejection head can be assembled with high precision.

Subsequently to the performing, the finishing work is executed over the material strip 55 between the first die 51*a* and the finishing die 57. In the finishing die 57 having the flat surface 57*a*, the concave portion 57*b* for accommodating the bulged portion 55*a* formed on the metal material plate 55 is provided in the part corresponding to the concave portion 54*a* of the preforming die 56. By further pressurizing the material strip 55 toward the projections 53*c* through the flat surfaces 57*a*, the height of the flow of the material strip 55 into the gaps 53*b* is set to be as uniform as possible in the longitudinal direction of the gaps 53*b*. At this time, since the bulged portion 55*a* is accommodated in the housing concave portion 57*b*, the material strip 55 in an amount corresponding to the bulged portion 55*a* is not moved into the gaps 53*b* but effectively serves to cause the height of the flow to be uniform.

The function of suppressing the flow of the material strip 65 is substantially realized by causing the outer periphery 68*a* of the regulating member 68 to receive the escaping flow of the material strip 55. Accordingly, the outer periphery 68*a* may be configured in any way if the escaping flow of the material strip 55 can be suitably received.

In summary, when the material strip 55 (the chamber formation plate 30) which is pressurized between both of the dies 51*a* and 52*a*, the escaping flow of the material strip 55 is suppressed by the regulating members 68 and the regulation recess 65. Therefore, a large amount of the material strip 55 flows into the gaps 53*b* so that the partition walls 28 can be formed with a sufficient height. Since the elongated recess portions 33 are formed simultaneously with the formation of the partition walls 28, the depth of the elongated recess portions 33 can be maintained sufficiently. The partition walls 28 thus formed can be adjusted to have a specified height in the finish working such as abrasion working. By maintaining the partition walls 28 having a sufficient height as described above, it is possible to secure a finish margin used to adjust the volume and shape of the pressure generating chambers 29 with high precision.

The height of the partition wall 28 formed in the gap 53*b* mainly depends on the shape of the die as described above. On the other hand, it is possible to form the chamber formation plate 30 much better by improving the surface condition of the die.

Figure 21A:
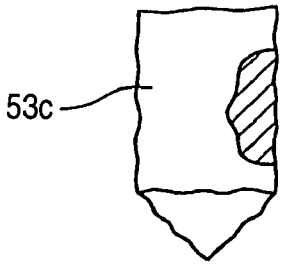
FIG. 21A is a view showing an original state of one projection on the male die of FIG. 17B.

The surface polishing and the hard coating of the die which will be described below are carried out over at least a part of the surface of the die. The processing described above is carried out over at least one of the first die 51*a* and the second die 52*a*. FIG. 21A shows an original state of the projection 53*c* which is formed by the well-known electric discharge machining. In terms of the surface roughness of the projection 53*c* measured by a stylus method, a mean roughness of the center line of the unevenness Ra was 1.79 μm, a maximum roughness Ry was 12.6 μm, and a ten-point mean roughness Rz was 7.8 μm.

Figure 21B:
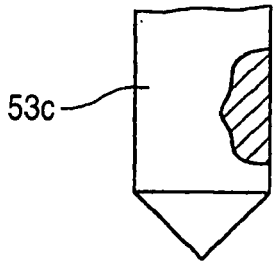
FIG. 21B is a view showing the projection subjected to a polishing.

Next, as shown in FIG. 21B, the projection 53*c* is subjected to abrasion finishing through a profile grinder having a #1000 diamond grindstone. As the results of the same measurement, Ra was 0.95 μm, Ry was 7.7 μm and Rz was 4.9 μm. It can be acknowledged that the surface roughness is considerably improved.

Figure 21C:
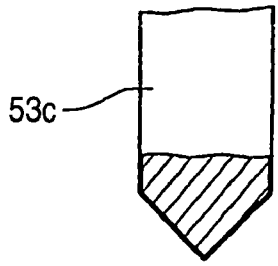
FIG. 21C is a view showing the projection to which a hard coating is applied.

As shown in FIG. 21C, finally, the hard coating was carried out by a DLC (diamond like carbon) coated film. A film forming process was performed by a predetermined DLC coating apparatus in such a manner that the DLC coated film has a thickness of 1.0±0.2 μm. The surface roughness in a state in which the DLC coated film is coated has the same value as a value obtained after the abrasion finishing.

Consequently, the surface of the die is smooth and has a high hardness. Therefore, the movement of the material strip 55 sliding along the surface of the die is carried out smoothly and the plastic flow of the material strip 55 into each part of the die, for example, the gaps 53*b* of the first die 51*a* can be performed sufficiently, which is effective for increasing the height of the partition walls 28.

The abrasion finishing is carried out through profile grinding. Consequently, a finished surface having high precision can be obtained down to a portion of the die having a complicated shape. For the hard coating, moreover, a DLC coated film is formed so that the surface of the die is coated with a carbon coated film equivalent to diamond. Consequently, an abrasion resistance can be enhanced with a high hardness. In addition, the DLC coated film has a low coefficient of dynamic friction. Therefore, the flow of the material strip 55 coming in contact with the die can also be carried out smoothly and the height of the partition wall 28 can be advantageously increased. In addition, the abrasion resistance is excellent and the damage of the die can also be prevented so that the lifetime of the die is increased.

Since the material 55 flowing into the gaps 53*b* as configured the above constitutes the partition walls 28 of the elongated recess portions 33, the shape of the elongated recess portions 33 can be formed accurately. For forming such a minute structure, an anisotropic etching method is generally employed. Since such a method requires a large processing man-hour, it is disadvantageous in respect of the manufacturing cost. On the other hand, if the forging punch is used for a metallic material such as nickel, the processing man-hour is considerably reduced. Furthermore, since the processing can be carried out with a uniform volume of each elongated recess portion 33, in a case where the pressure generating chamber of the liquid ejection head is to be formed, the ejection performance of the liquid ejection head is stabilized.

Moreover, the communicating port 34 communicating with the nozzle orifice 48 and the pressure generating chamber 29 is formed so as to overlap the groove 75 which is formed by the forging work. Since the portions between adjacent communicating ports 34 can be made flat, the joining of the nozzle plate and the plate member by the adhesive agent can be reliably executed.

Figure 22:
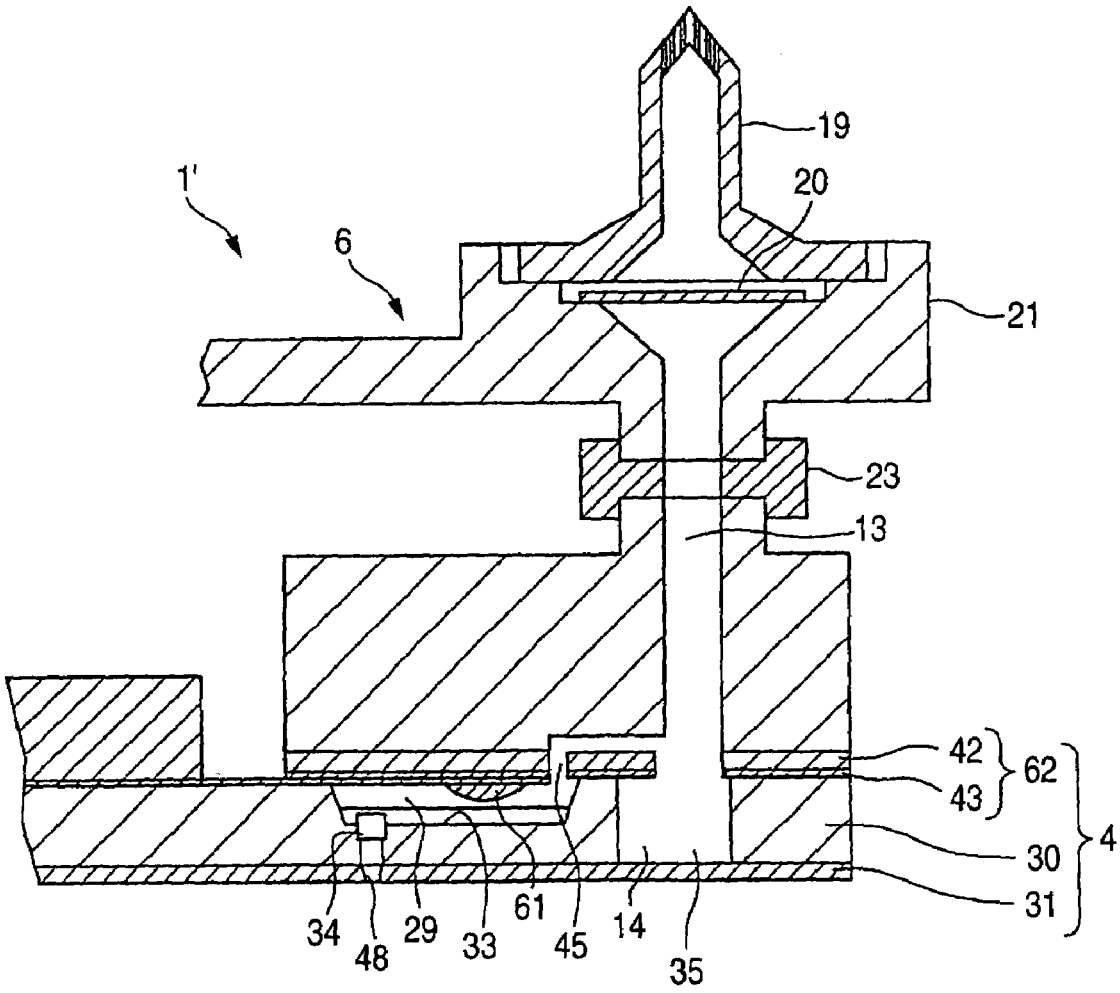
FIG. 22 is a sectional view for explaining an ink jet recording head according to a second embodiment of the invention.

As a second embodiment, a recording head 1' shown in FIG. 22 adopts a heat generating element 61 as the pressure generating element According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiment are achieved.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A method of manufacturing a liquid ejection head which ejects liquid droplets by generating pressure fluctuation in liquid contained in a plurality of pressure generating chambers communicated with a common liquid reservoir, the method comprising steps of:

providing a metallic plate member having at least one through hole to be a part of the common liquid reservoir;

providing a first die, in which a plurality of first projections are arrayed in a first direction with a fixed pitch, each of the first projections being elongated in a second direction perpendicular to the first direction;

providing a second die, on which the plate member is mounted;

inserting a regulating member into the through hole; and performing a first forging work in which the first projections are pressed against a first region in a first face of the plate member which is adjacent to the through hole in the second direction, the first projections being pressed in a third direction orthogonal to the first direction and the second direction, so as to generate a plastic flow of a material in the plate member into gaps defined between the first projections, while the plastic flow is regulated by the regulating member, wherein a plurality of recesses formed by the first projections and a plurality of partition walls formed by the material flown into the gaps constitutes a part of the pressure generating chambers.

2. The manufacturing method as set forth in claim 1, further comprising step of performing a second forging work in which a recess extending in the first direction is formed on the first face of the plate member, before the first forging work is performed, wherein the first region is situated between the recess and the through hole.

3. The manufacturing method as set forth in claim 1, wherein:

the second die comprises a plurality of second projections arrayed in the first direction with a fixed pitch, each of which is elongated in the second direction; and the first forging work is performed such that the second projections are opposed to the first projections through the plate member.

4. The manufacturing method as set forth in claim 2, wherein the plate member is formed with a pair of through holes, and the recess is formed between the through holes.

5. The manufacturing method as set forth in claim 1, further comprising steps of:

mounting the plate member on a third die having a flat face; and performing a second forging work in which the first projections are pressed against the first region of the plate member under a condition that the flat face opposes to the first projections through the plate member.

6. The manufacturing method as set forth in claim 5, wherein the second forging work is performed under a condition that the regulating member is inserted into the through hole.

7. The manufacturing method as set forth in claim 3, wherein each of the second projections is provided with a concave portion at a distal end thereof, so as to extend in the second direction.

8. The manufacturing method as set forth in claim 5, wherein the third die comprises a pair of third projections arrayed in the second direction, each of which is elongated in the first direction and has a flat distal end face.

9. The manufacturing method as set forth in claim 5, further comprising steps of: polishing a surface of at least one of the first die, the second die and the third die; and performing a hard coating onto the polished surface.

10. The manufacturing method as set forth in claim 9, wherein a profile grinding is performed in the polishing step.

11. The manufacturing method as set forth in claim 9, wherein a diamond like carbon film is coated as the hard coating.

12. A method of manufacturing a liquid ejection head for ejecting liquid droplets by generating pressure fluctuation in liquid contained in a plurality of pressure generating chambers communicated with a common liquid reservoir, the method comprising steps of:

providing a metallic plate member at least one through hole to be a part of the common liquid reservoir;

providing a first die, in which a plurality of first projections are arrayed in a first direction with a fixed pitch, each of the first projections being elongated in a second direction perpendicular to the first direction;

providing a second die, on which the plate member is mounted;

performing a first forging work in which a recess extending in the first direction is formed on a first face of the plate member so as to be adjacent to the through hole in the second direction; and performing a second forging work in which the first projections are pressed against a first region in the first face of the plate member between the through hole and the recess, the first projections being pressed in a third direction orthogonal to the first direction and the second direction, so as to generate a plastic flow of a material in the plate member into gaps defined between the first projections, while the plastic flow is regulated by the recess, wherein a plurality of recesses formed by the first projections and a plurality of partition walls formed by the material flown into the gaps constitutes a part of the pressure generating chambers.

13. The manufacturing method as set forth in claim 12, further comprising steps of: polishing a surface of at least one of the first die and the second die; and performing a hard coating onto the polished surface.

14. The manufacturing method as set forth in claim 13, wherein a profile grinding is performed in the polishing step.

15. The manufacturing method as set forth in claim 13, wherein a diamond like carbon film is coated as the hard coating.

16. An apparatus for manufacturing a liquid ejection head which ejects liquid droplets by generating pressure fluctuation in liquid contained in a plurality of pressure generating chambers communicated with a common liquid reservoir, the apparatus comprising:

a first die, in which a plurality of first projections are arrayed in a first direction with a fixed pitch, each of the first projections being elongated in a second direction perpendicular to the first direction;

a second die, on which a plate member having at least one through hole to be a part of the common liquid reservoir is mounted;

a regulating member, adapted to be inserted into the through hole;

a press member, operable to press the first projections against a first region in a first face of the plate member which is adjacent to the through hole in the second direction, under a condition that the regulating member is inserted into the through hole, wherein:

the first projections are pressed in a third direction orthogonal to the first direction and the second direction, so as to generate a plastic flow of a material in the plate member into gaps defined between the first projections, while the plastic flow is regulated by the regulating member; and a plurality of recesses formed by the first projections and a plurality of partition walls formed by the material flown into the gaps constitutes a part of the pressure generating chambers.

17. The manufacturing apparatus as set forth in claim 16, wherein:

the second die comprises a plurality of second projections arrayed in the first direction with a fixed pitch, each of which is elongated in the second direction; and the first projections are pressed so as to oppose to the second projections through the plate member.

18. The manufacturing apparatus as set forth in claim 16, wherein a surface of at least one of the first die and the second die is polished, and a hard coating is provided on the polished surface.

19. The manufacturing apparatus as set forth in claim 18, wherein the surface is polished by a profile grinding.

20. The manufacturing apparatus as set forth in claim 18, wherein a diamond like carbon film is provided as the hard coating.

* * * * *